US007318417B2

(12) United States Patent
Lang et al.

(10) Patent No.: US 7,318,417 B2
(45) Date of Patent: Jan. 15, 2008

(54) INJECTION UNIT AND INJECTION METHOD FOR AN INTERNAL COMBUSTION ENGINE

(75) Inventors: Richard Lang, Neumarkt-Pölling (DE); Gerald Plank, Fensterbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/596,001

(22) PCT Filed: Nov. 3, 2004

(86) PCT No.: PCT/EP2004/052775

§ 371 (c)(1),
(2), (4) Date: May 24, 2006

(87) PCT Pub. No.: WO2005/052355

PCT Pub. Date: Jun. 9, 2005

(65) Prior Publication Data

US 2007/0095329 A1 May 3, 2007

(30) Foreign Application Priority Data

Nov. 27, 2003 (DE) ..... 103 55 411

(51) Int. Cl.
*F02M 37/04* (2006.01)

(52) U.S. Cl. ..... 123/467; 123/514

(58) Field of Classification Search ..... 123/467, 123/514, 179.17, 500, 501, 446, 456, 506
See application file for complete search history.

(56) References Cited

U.S. PATENT DOCUMENTS 4,813,601 A 3/1989 Schwerdt et al. ..... 239/91
6,145,492 A * 11/2000 Lixl ..... 123/467
6,253,736 B1 * 7/2001 Crofts et al. ..... 123/498
6,328,017 B1 * 12/2001 Heinz et al. ..... 123/467
6,367,453 B1 * 4/2002 Igashira et al. ..... 123/467

(Continued)

FOREIGN PATENT DOCUMENTS

DE 3742241 8/1988

(Continued)

OTHER PUBLICATIONS

International Search Report and Written Opinion for International Patent Application No. PCT/EP2004/052775 (10 pages), Nov. 3, 2004.

*Primary Examiner*—Carl S. Miller
(74) *Attorney, Agent, or Firm*—Baker Botts L.L.P.

(57) ABSTRACT

An injection unit has an injector arrangement connected to a pressure reservoir by a pressure line arrangement The injector arrangement has at least one servo injection valve and a control valve for the release of fuel from a control chamber into a fuel return line leading to the fuel tank The Valve may be operated by a piezoelectric actuator to cause a displacement of a nozzle body in the direction of an injection passage opening for initiating an injection process by pressure reduction in the control chamber. The fuel return line has a controllable valve, which restricts the fuel flow in the fuel return line in the actuated state. It is, thus, possible to reduce the effects of a change of length of the piezoelectric actuator, which exceeds the so-called tolerance gap in the servo injection valve, which are detrimental to the operation of the injection unit.

18 Claims, 2 Drawing Sheets

U.S. PATENT DOCUMENTS

| | | | | |
|---|---|---|---|---|
| 6,532,938 | B1 | 3/2003 | Mahr et al. | 123/447 |
| 6,659,086 | B2 * | 12/2003 | Rodriguez-Amaya et al. | 123/467 |
| 6,688,289 | B2 * | 2/2004 | Rodriguez-Amaya et al. | 123/467 |
| 6,691,682 | B2 * | 2/2004 | Rueger et al. | 123/467 |
| 6,908,043 | B2 * | 6/2005 | Boecking | 239/88 |

FOREIGN PATENT DOCUMENTS

| | | |
|---|---|---|
| DE | 196 49 139 A1 | 6/1997 |
| DE | 19905340 | 8/2000 |
| DE | 10015740 | 10/2001 |
| DE | 101 04 634 A1 | 9/2002 |
| WO | 01/12982 A1 | 2/2001 |

* cited by examiner

INJECTION UNIT AND INJECTION METHOD FOR AN INTERNAL COMBUSTION ENGINE

CROSS-REFERENCE TO RELATED APPLICATIONS

This application is a U.S. national stage application of International Application No. PCT/EP2004/052775 filed Nov. 3, 2004, which designates the United States of America, and claims priority to German application number DE10355411.4 filed Nov. 27, 2003, the contents of which are hereby incorporated by reference in their entirety.

TECHNICAL FIELD

The present invention relates to an injection unit and to a method for operating an injection unit for an internal combustion engine.

BACKGROUND

An injection unit of this type and an injection method of this type are known for example from DE 100 15 740 A1. In this known technology, an injector arrangement comprises at least one servo injection valve, which can be actuated by means of a piezoelectric actuator, to cause a displacement of a servo valve nozzle body (nozzle needle) in the direction of an opening of an injection passage which is provided between a nozzle chamber of the servo injection valve and a combustion chamber of the internal combustion engine concerned, for initiating an injection process by pressure reduction in the control chamber.

A key advantage of using a servo injection valve actuated by means of a piezoelectric actuator is that a comparatively small excursion of the piezoelectric actuator can achieve an excursion of the nozzle body that is independent thereof and, as a rule, many times greater (excursion ratio). In addition, the advantage is produced here that the displacement of the nozzle body for opening and closing the injection passage is driven by the pressure of the fuel which for the purposes of injection into the combustion chamber is in any case available under comparatively high pressure in the area of the injection valve. A piezoelectric actuator having a comparatively limited excursion and comparatively low actuating force is therefore adequate for actuating the injection valve.

A piezoelectric actuator comprises, as a rule, a stack of piezoelements lying on top of one another which, when an electric voltage is applied, rapidly alters its length by an extent dependent upon, among other things, the voltage. A great variety of piezoelectric ceramics are known that are suitable for this purpose, for example lead zirconate/titanate ceramics, and are of interest for use in injection valves principally due to their rapid rate of change and their high piezoelectric forces.

Since, however, the length of the piezoelectric actuator does not depend exclusively on the voltage applied, but is also subject, for example, to manufacturing tolerances and a dependency on the temperature of the actuator, when a servo injection valve actuated by a piezoelectric actuator is designed, a more or less large gap is provided in the path of action from the actuator to a control valve body which serves as a range of tolerance for undesired variances and/or changes in the actuator length.

This so-called tolerance gap in the piezo-actuated injection valve should, on the one hand, be dimensioned as small as possible in order to maximize the usable excursion of the actuator, and on the other hand be dimensioned as large as possible in order to avoid, in all operating states if possible, a change in the length of the piezoelectric actuator caused by the operation exceeding the tolerance gap and in this way, without the actuator being actuated, actuating the control valve. Particularly important in the latter regard is, for example, a thermally driven extension of the piezoelectric ceramic at raised actuator temperature, as can occur under certain circumstances, particularly in the operation of the internal combustion engine. Accordingly, the tolerance gap can in practice be difficult to dimension "optimally".

If the tolerance gap due to a temperature increase of the actuator can be exceeded and if consequently the fuel fed from the pressure reservoir via a pressure line to the control chamber can be released further via the control valve into the practically unpressurized (compared with the fuel system pressure in the pressure reservoir) fuel return line, then further problems arise. Namely, if the internal combustion engine is to be started in a "warm state", e.g. after the internal combustion engine had previously run for quite a long period and subsequently been switched off, then due to the release of fuel from the control chamber into the fuel return line, the building up of pressure in the pressure reservoir can be hampered or delayed considerably. The build-up of a certain minimum system pressure, which typically stands at a few hundred bar, is however necessary in order to be able to achieve any injection at all from the nozzle chamber into the combustion chamber.

From DE 199 05 340 C2 a method and an arrangement for presetting and dynamically correcting piezoelectric actuators are known in which a direct voltage, possibly superimposed on a pulsed actuation voltage, is fed for this purpose to the piezoelectric actuator. This direct voltage component then determines a new position of rest of the actuator and can thus be used for adjusting the idle stroke and for correcting the idle stroke when running.

From DE 37 42 241 A1, a piezoelectric control valve is known which consists of a piezoelectric actuator arranged in a housing and a valve. Possible changes in length of the reference system are automatically compensated for by a hydraulic play-compensating element inside the control valve, so that for a given working excursion of the piezoelectric actuator a uniform excursion is always ensured at the valve. A disadvantage of these two approaches to solving the problems explained in the introduction is the outlay associated with them in terms of the electronic devices for controlling the injector arrangement and in terms of the injector arrangement itself.

SUMMARY

One object of the present invention is accordingly to indicate an injection unit and an injection method for an internal combustion engine in which the effects of a change of length of the piezoelectric actuator exceeding the tolerance gap in the servo injection valve, said effects being detrimental to the operation of the injection unit or of the internal combustion engine, can be reduced or eliminated.

This object can be achieved with an injection unit for an internal combustion engine, comprising a pressure reservoir for storing fuel pumped into the pressure reservoir from a fuel tank by means of a high-pressure pump, and an injector arrangement, connected to the pressure reservoir by means of a pressure line arrangement, for injecting the fuel into the internal combustion engine, wherein the injector arrangement comprises at least one servo injection valve in which both a nozzle chamber and a control chamber are supplied with fuel from the pressure reservoir via a pressure line and in which a nozzle body for opening and closing an injection passage leading from the nozzle chamber to a combustion chamber is displaceably guided, and the nozzle body is exposed at its end facing the injection passage to the pressure of the fuel in the nozzle chamber and at its opposing end to the pressure of the fuel in the control chamber, wherein the servo injection valve is provided with a control valve for the release of fuel from the control chamber into a fuel return line leading to the fuel tank, which control valve may be operated by means of a piezoelectric actuator to cause a displacement of the nozzle body in the direction of an opening of the injection passage, for initiating an injection process by pressure reduction in the control chamber, wherein the fuel return line is provided with a controllable valve which in an actuated state blocks the fuel flow in the fuel return line, and wherein the valve is actuated depending on predefined operating parameters of the internal combustion engine and/or the injection unit and is returned to an idle state only after expiration of a predeterminable time interval.

The injector arrangement may comprise a plurality of servo injection valves which are connected via the pressure line arrangement to the pressure reservoir used jointly for this plurality of servo injection valves. The injector arrangement may comprise a plurality of servo injection valves whose fuel return lines are combined, whereby the combined fuel return line section is provided with the controllable valve. The predefined operating parameters may comprise the existence or non-existence of an actuator overshoot in the servo injection valve. The idle state of the valve after an actuation can be maintained compulsorily for a stipulated fixed further time interval. The injection unit may further comprise an electronic injection control unit (ECU) for operating the injector arrangement and for actuating the controllable valve.

The object can also be achieved by a method for operating such an injection unit for an internal combustion engine, wherein the method comprises the steps of actuating the control valve by means of a piezoelectric actuator, to cause a displacement of the nozzle body in the direction of an opening of the injection passage, for initiating an injection process by pressure reduction in the control chamber, and blocking of the fuel flow in the fuel return line, said blocking being provided depending on predefined operating parameters of the internal combustion engine and/or of the injection unit and not being lifted again until after expiration of a predeterminable time interval.

The predefined operating parameters may comprise the existence or non-existence of an actuator overshoot in the servo injection valve. The lifting of the blocking can be compulsorily maintained for a stipulated fixed further time interval.

Essential to the invention is the fact that in the injection unit the fuel return line is provided with a controllable valve which in an actuated state restricts the fuel flow in the fuel return line and that in the injection method an optional restriction of the fuel flow in the fuel return line is provided. Where the tolerance gap is exceeded by a change of length of the actuator that is independent of the actual piezoelectric control, hereinafter also called "actuator overshoot" for short, the negative effects of this situation can be alleviated or even eliminated in a relatively simple manner through restriction of the fuel flow. If an actuator overshoot applies and the flow of fuel in the fuel return line is restricted, then this leads to a rise in pressure in the fuel return line between the location of the restriction and the return fuel outlet of the servo injection valve. In this way, it is possible on the one hand to avoid the nozzle body being displaced unintentionally (without active actuation by the actuator) in the direction of an opening of the injection passage as a result of the actuator overshoot, which is of importance particularly when the internal combustion engine is running. On the other hand, it is possible in this way to eliminate the problem of the warm starting of the internal combustion engine (in the event of a temperature-determined actuator overshoot) that exists due to the delayed build-up of system pressure, since the rise in pressure in the fuel return line accelerates the pressure build-up in the pressure reservoir considerably.

A further advantage of the solution according to the invention is that this can also be achieved simply as part of a retrofit, since this requires essentially only a modification of the fuel return line arrangement, e.g. by installing a further controllable valve, and a comparatively simple modification or amendment of the engine control electronics, for which in practice already existing sensor-technology devices for recording operating states of the internal combustion engine and/or of the injection unit can advantageously also often be used.

The invention can advantageously ensure a constant readiness to travel of a vehicle operated by means of an internal combustion engine even where an actuator overshoot possibly occurs in injection valves, this hydraulic solution being usable not only in the start-up phase of the internal combustion engine but also while it is running, in order for example to "cushion" any operationally-caused change of length of the actuator.

Of course, the measures according to the invention can be used in combination with the measures already implemented previously, such as e.g. with the above-mentioned active electrical configuration or tracking of the actuator's idle stroke (active piezo contraction) or a cooling of the internal combustion engine.

One embodiment provides that the injector arrangement comprises a plurality of servo injection valves which are connected via the pressure-line arrangement to the pressure reservoir jointly used for this plurality of servo injection valves. Injection units of this type are known in the art as so-called reservoir injection systems, which operate as a rule with very high injection pressures (e.g. in the range from a few hundred bar up to approximately 1,600 bar). Such systems are known as common-rail systems (for diesel engines) and HPDI injection systems (for petrol engines).

If the injector arrangement comprises a plurality of servo injection valves, as will usually be the case, then each of the plurality of fuel return lines could be provided with its own controllable valve for restricting fuel flow. However, since a fuel flow restriction in the fuel return line in practice scarcely impairs the proper functioning of a servo injection valve connected thereto, in which there is no actuator overshoot, a simplification can be achieved in that the fuel return lines are joined to this plurality of servo injection valves and the fuel flow restriction is provided in the combined fuel return line section, that is e.g. the controllable valve is arranged only in this combined fuel return line section.

A simple actuation of the control valve is produced if the piezoelectric actuator acts on a valve body of the control valve via a tappet, whereby the tolerance gap can be provided between actuator and tappet or between tappet and valve body.

A particularly enhanced effect of the fuel flow restriction in the fuel return line can be provided by blocking, i.e. restricting fully, the fuel flow in the actuated state of the control valve.

In one embodiment, the injection unit comprises further an electronic injection control unit for operating the injector arrangement and for actuating the controllable valve. In this case, the functions of the actual injection control and of the actuation of the controllable valve are advantageously combined for restricting fuel flow. In this case, operating parameters needed for actuating the controllable valve can be drawn directly or derived from the injection control.

In a preferred embodiment, the controllable valve is actuated depending on predefined, specially measured operating parameters of the internal combustion engine and/or of the injection unit. Such operating parameters can comprise in particular the fuel pressure in the pressure reservoir, the fuel pressure in the fuel return line, the temperature in an area of the internal combustion engine or of the injection unit, the rotational speed of the internal combustion engine as well as its load or its actuation (accelerator pedal position), etc. Particularly advantageously, operating parameters which are representative of the status of individual or of all the piezoelectric actuators (e.g. in respect of their temperature and/or length at rest) can also be used. The latter parameters can be obtained indirectly, for example from an electronic apparatus for the actuation of piezoactuators (engine control unit), e.g. by recording the electrical capacity of the actuators. Finally, suitable parameters can also be derived from the characteristics, often recorded anyway (e.g. for regulating injection quantities), of the displacement of the nozzle body in response to a piezoactuation when the injection unit is operating. For recording this characteristic, known servo injection valves of the type which is of interest here are often equipped with a sensor technology sensitive to the position of the nozzle body.

In a preferred embodiment, a plurality of operating parameters, such as those mentioned above, are combined in an electronic evaluation device, and actuation signals for the controllable valve(s) for restricting the fuel flow in the fuel return line are generated from a previously stored engine characteristics map and are fed to these valves for electronic actuation.

A further embodiment of the invention provides that the controllable valve for restricting fuel flow is actuated upon existence of a defined operating parameter status for the restriction of fuel flow and after a stipulated fixed time interval (or alternatively after a time interval dependent on the temporal course of defined operating parameters) returned to the idle status. This idle status can then be maintained compulsorily, e.g. for a stipulated fixed further time interval (dead time). By means of measures of this type, the fuel flow restriction can be severely limited from the viewpoint of time so that in particular a system that is subsequently retrofitted in accordance with the invention is negligibly impaired in terms of its normal functioning.

Another further development of the invention provides that the restriction of fuel flow is arranged such that a predetermined maximum pressure in the fuel return line cannot be exceeded. This could, for example, be realized by measuring the fuel return line pressure and, based upon that, compulsorily disabling the restriction of fuel flow in the event of the maximum pressure being reached. Alternatively or additionally, however, there is the simple option of providing the relevant fuel flow restricting means (valve) with a bypass line arranged in parallel which, when the maximum pressure is reached, opens automatically and in this way reliably prevents unwanted excess pressure in the fuel return line. The avoidance of an excess pressure in the fuel return line serves here in particular to protect the injection servo valves concerned, whose fuel return path, in order to prevent damage, must not have too high a pressure (typically e.g. 3.5 bar).

BRIEF DESCRIPTION OF THE DRAWINGS

The invention will be explained in detail below with the aid of an exemplary embodiment with reference to the enclosed drawings, in which.

DETAILED DESCRIPTION

Figure 1:
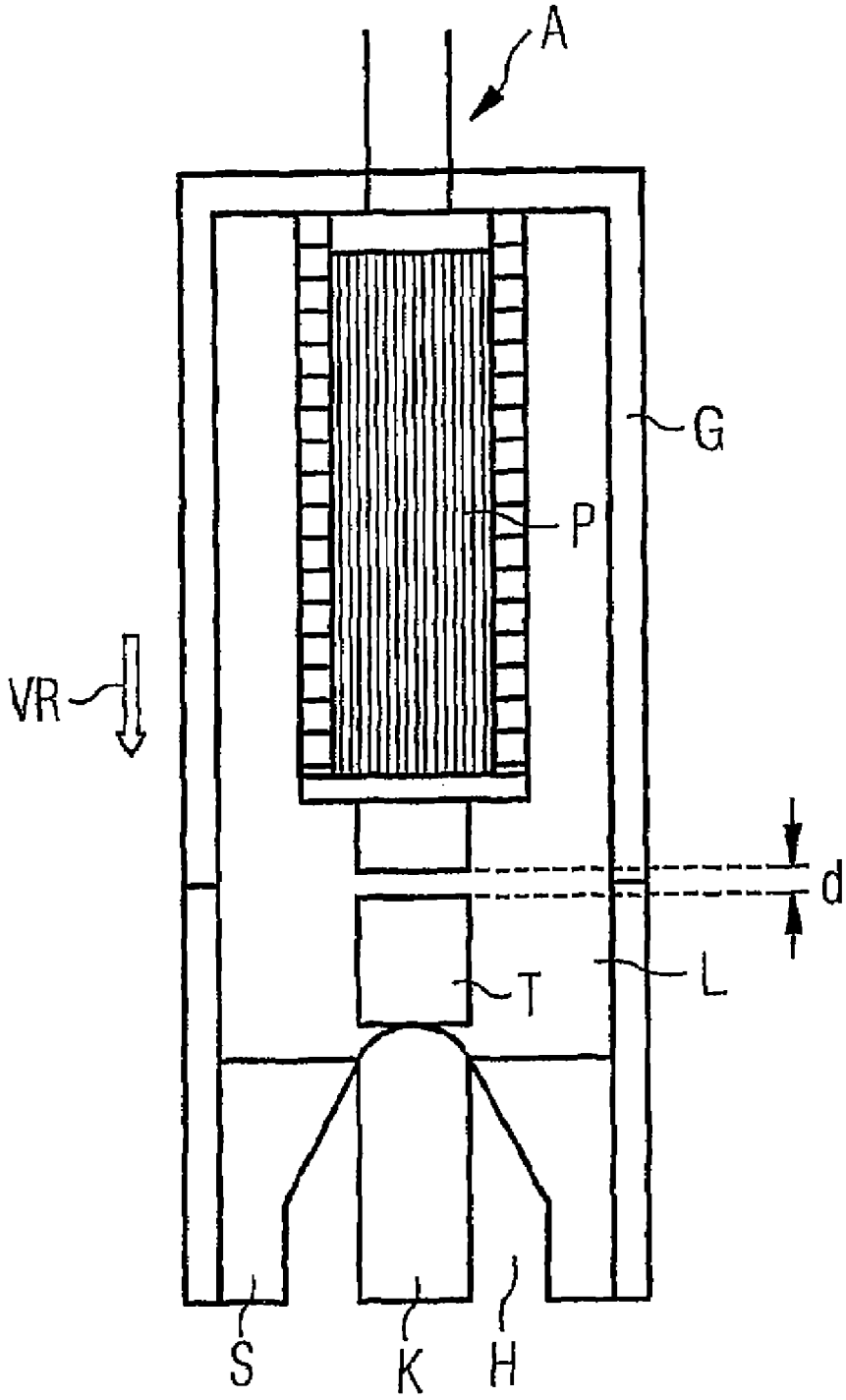
FIG 1 Prior art
FIG. 1 shows a schematic representation for illustrating the tolerance gap in a piezo-actuated servo injection valve.

FIG. 1 shows schematically a part of a high-pressure injection servo valve for an internal combustion engine, said valve being in its closed state.

This high-pressure valve has a low-pressure area L connected to a fuel return line (not shown) and a high-pressure area H connected to a pressure reservoir via a pressure line (not shown). These two areas L, H under differing applied pressures are separated from one another by a control valve, which is formed by a control valve seat S and a control valve body K forced by the high pressure in the high-pressure area H against the control valve seat S.

The high-pressure area H forms a control chamber (not shown) or is connected to such a control chamber in which the pressure prevailing there acts upon the rear (upper) end of an axially displaceably supported and guided nozzle body (nozzle needle) so as to press a front (lower) end of this nozzle body against an injection nozzle valve seat (not shown) and in this way to close injection passages leading to a combustion chamber of the internal combustion engine. Although the front end of the nozzle body is arranged in a nozzle chamber which is likewise under high pressure, in this way the nozzle body in the idle state shown is nonetheless pressed downward to close the injection passages, since the force pressing the nozzle body downward is, on account of a relatively large dimensioned cross-sectional area of the nozzle body at its upper end, greater than the force acting at the lower end of the nozzle body. To initiate an injection process, the pressure in the control chamber or in the high-pressure area H is reduced in the manner described below in order to cause a displacement of the nozzle body in the direction of an opening of the injection passage.

The reduction in pressure in the high-pressure area H is effected through actuated opening of the control valve formed by the valve seat S and the valve body K by means of a piezoelectric actuator P which is surrounded in the low-pressure area L by a housing G and is provided with electrical terminals A for its actuation. By applying a voltage to the terminals A of the actuator P, the length of the actuator can be extended in the direction of the arrow VR (preferred polarization of the piezoelectric ceramic) in order to act via a tappet T on the valve body K. A tolerance gap d is provided here between the actuator P and the tappet T, said tolerance gap serving as a safety clearance for thermal changes in length of the piezoceramic and typically having a dimension of between 3 and 5 μm. If changes in length now occur in the piezoelectric actuator P, e.g. because of adverse environmental influences, said changes in length exceeding the dimension of this gap d, then the actuator P in idle status presses via the tappet T on the valve body K, which ultimately leads to a return of fuel from the high-pressure area H to the low-pressure area L and the fuel return line connected thereto. When the internal combustion engine is running, this actuator overshoot signifies a tendency for the servo injection valve to open even when this is not actively actuated electrically via the terminals A. In the event of the internal combustion engine being started warm, this means that the build-up of pressure in the pressure reservoir cannot be established (or not rapidly) to the extent that is required for starting fuel injection.

These problems are avoided, however, by the injection unit design described below with reference to FIG. 2, in which, particularly with a view to recording such an actuator overshoot, the hydraulic pressure in the low-pressure area L is increased at times.

Figure 2:
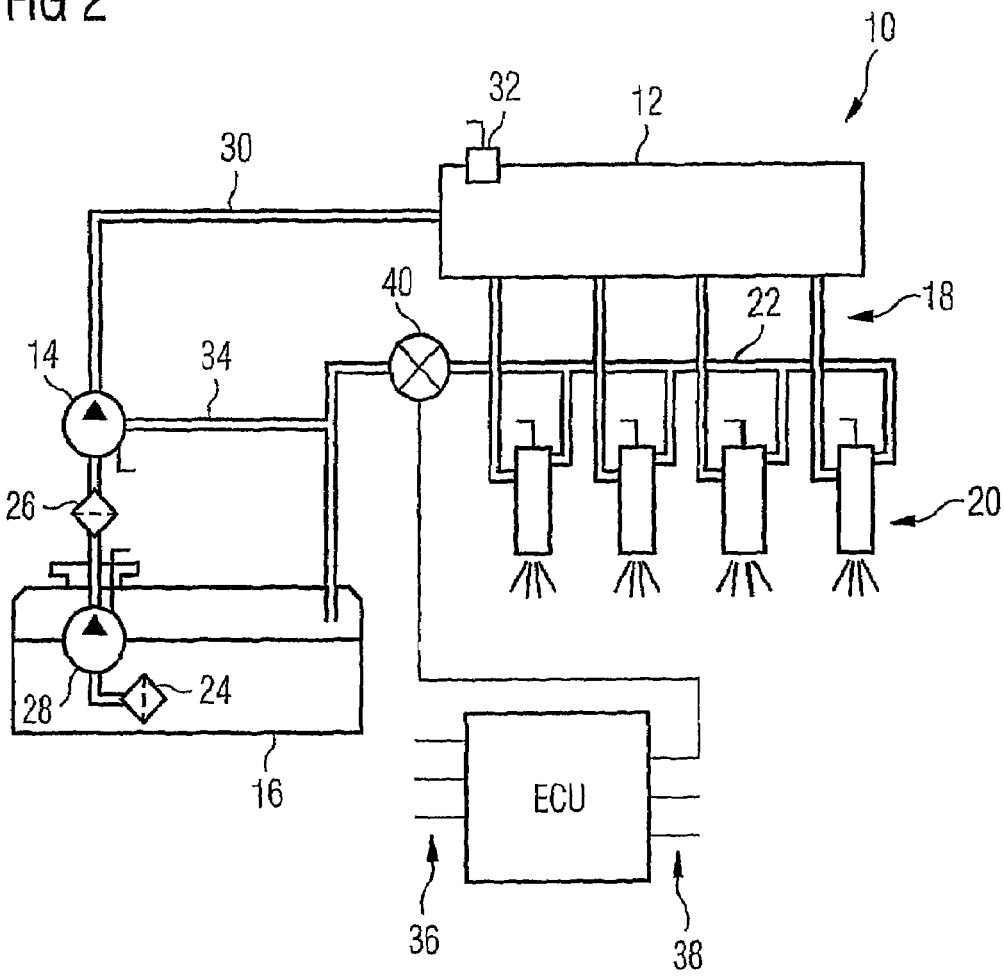
FIG. 2 shows a schematic representation of an injection unit in which a plurality of servo injection valves of the type shown in FIG. 1 are used.

FIG. 2 shows an injection unit 10 for an internal combustion engine (not shown), comprising a pressure reservoir 12 for storing fuel pumped into the pressure reservoir 12 from a fuel tank 16 by means of a high-pressure pump 14 and an injector arrangement 20, connected to the pressure reservoir 12 via a pressure line arrangement 18, for injecting the fuel into the internal combustion engine. In the exemplary embodiment shown, the injector arrangement 20 consists of four servo injection valves which are supplied with fuel via four separate pressure lines 18 from the pressure reservoir 12 provided for these jointly.

Each of the servo injection valves in this case is of the type of construction explained with reference to FIG. 1 and has a control chamber and a nozzle chamber which are both supplied with fuel from the pressure reservoir 12 via the respective pressure line, this fuel being under the high system pressure provided by the high-pressure pump 14. Servo injection valves of this type are adequately known to persons skilled in the art, so a more detailed explanation can be dispensed with here.

As already described with reference to FIG. 1, an injection process is initiated in each case by reducing pressure in the control chamber of the respective servo injection valve, which is provided for this purpose with a piezoelectrically actuated control valve for releasing fuel from the control chamber into a fuel return line 22.

Also to be seen in FIG. 2 are two fuel filters 24 and 26 for coarse and fine filtering of the fuel which is pumped via a preliminary feed pump 28 to an intake of the high-pressure pump 14, a high-pressure line 30 for carrying the fuel which has been placed under system pressure from the high-pressure pump 14 to the pressure reservoir 12, a high-pressure sensor 32 for measuring the pressure in the pressure reservoir 12, a fuel return line 34 outgoing from the high-pressure pump 14 for carrying excess fuel from the pump 14 to the fuel return line 22 and thus back to the fuel tank 16, and an electronic engine control unit ECU with a series of input terminals 36 and a series of output terminals 38, by means of which in a manner known in the art operating parameters of the internal combustion engine and of the injection unit are recorded and evaluated via the input terminals 36 and signals are generated at the output terminals 38 with which signals the electrical and electronic components of the system are controlled, e.g. the shown components 28, 14, 20.

In addition to this, the engine control unit ECU controls a fuel return control valve 40 arranged in the combined course of the fuel return line 22, with which fuel return control valve, depending on the operating parameters recorded and by means of a suitably configured engine characteristics map, the fuel return flow from the individual injectors of the injector arrangement 20 via the fuel return line 22 to the fuel tank 16 can be blocked. By evaluating the measured operating parameters, the engine control unit ECU detects, using methods known in the art, any actuator overshoot that arises in one of the injectors and causes in such a case a short-term actuation of the fuel return control valve 40 for short-term blocking of the fuel return flow, e.g. for a stipulated fixed time interval of a few seconds. In this way, it is possible both to accelerate the build-up of pressure in the pressure reservoir 12, which tends to be delayed when there is an actuator overshoot, when starting the internal combustion engine warm and to cushion the internal combustion engine in the case of an actuator overshoot which occurs when the engine is running, and thus to keep it running properly.

What is claimed is:

1. An injection unit for an internal combustion engine, comprising a pressure reservoir for storing fuel pumped into the pressure reservoir from a fuel tank by means of a high-pressure pump, and an injector arrangement, connected to the pressure reservoir by means of a pressure line arrangement, for injecting the fuel into the internal combustion engine, wherein the injector arrangement comprises at least one servo injection valve in which both a nozzle chamber and a control chamber are supplied with fuel from the pressure reservoir via a pressure line and in which a nozzle body for opening and closing an injection passage leading from the nozzle chamber to a combustion chamber is displaceably guided, and the nozzle body is exposed at its end facing the injection passage to the pressure of the fuel in the nozzle chamber and at its opposing end to the pressure of the fuel in the control chamber, the servo injection valve is provided with a control valve for the release of fuel from the control chamber into a fuel return line leading to the fuel tank, which control valve may be operated by means of a piezoelectric actuator to cause a displacement of the nozzle body in the direction of an opening of the injection passage, for initiating an injection process by pressure reduction in the control chamber, the fuel return line is provided with a controllable valve which in an actuated state blocks the fuel flow in the fuel return line, and wherein the valve is actuated depending on predefined operating parameters of the internal combustion engine and/or the injection unit and is returned to an idle state only after expiration of a predeterminable time interval.

2. An injection unit according to claim 1, wherein the injector arrangement comprises a plurality of servo injection valves which are connected via the pressure line arrangement to the pressure reservoir used jointly for this plurality of servo injection valves.

3. An injection unit according to claim 1, wherein the injector arrangement comprises a plurality of servo injection valves whose fuel return lines are combined, whereby the combined fuel return line section is provided with the controllable valve.

4. An injection unit according to claim 1, wherein the predefined operating parameters comprise the existence or non-existence of an actuator overshoot in the servo injection valve.

5. An injection unit according to claim 1, wherein the idle state of the valve after an actuation is maintained compulsorily for a stipulated fixed further time interval.

6. An injection unit according to claim 1, further comprising an electronic injection control unit (ECU) for operating the injector arrangement and for actuating the controllable valve.

7. A method for operating an injection unit for an internal combustion engine, wherein the injection unit comprises:

a pressure reservoir for storing fuel pumped into the pressure reservoir from a fuel tank by means of a high-pressure pump, and an injector arrangement, connected to the pressure reservoir via a pressure line arrangement, for injecting the fuel into the internal combustion engine, wherein the injector arrangement comprises at least one servo injection valve in which both a nozzle chamber and a control chamber are supplied with fuel from the pressure reservoir via a pressure line and in which a nozzle body for opening and closing an injection passage leading from the nozzle chamber to a combustion chamber is displaceably guided, and the nozzle body is exposed at its end facing the injection passage to the pressure of the fuel in the nozzle chamber and at its opposing end to the pressure of the fuel in the control chamber, wherein the servo injection valve is provided with a control valve for the release of fuel from the control chamber into a fuel return line leading to the fuel tank, the method comprising the steps of:

actuating the control valve by means of a piezoelectric actuator, to cause a displacement of the nozzle body in the direction of an opening of the injection passage, for initiating an injection process by pressure reduction in the control chamber, blocking of the fuel flow in the fuel return line by a controllable valve, said blocking being provided depending on predefined operating parameters of the internal combustion engine and/or of the injection unit wherein the blocking is not being lifted until after expiration of a predeterminable time interval.

8. A method according to claim 7, wherein the predefined operating parameters comprise the existence or non-existence of an actuator overshoot in the servo injection valve.

9. A method according to claim 7, wherein the lifting of the blocking is compulsorily maintained for a stipulated fixed further time interval.

10. An injection unit for an internal combustion engine, comprising a pressure reservoir for storing fuel pumped into the pressure reservoir from a fuel tank by means of a high-pressure pump, and an injector arrangement comprising at least one servo injection valve in which both a nozzle chamber and a control chamber are supplied with fuel from the pressure reservoir via a pressure line and in which a nozzle body for opening and closing an injection passage leading from the nozzle chamber to a combustion chamber is displaceably guided, and the nozzle body is exposed at its end facing the injection passage to the pressure of the fuel in the nozzle chamber and at its opposing end to the pressure of the fuel in the control chamber, the servo injection valve comprising a control valve for the release of fuel from the control chamber into a fuel return line leading to the fuel tank, and a controllable valve which in an actuated state blocks the fuel flow in the fuel return line, and which is actuated depending on predefined operating parameters of the internal combustion engine and/or the injection unit and which is returned to an idle state only after expiration of a predeterminable time interval.

11. An injection unit according to claim 10, wherein the injector arrangement comprises a plurality of servo injection valves which are connected via the pressure line arrangement to the pressure reservoir used jointly for this plurality of servo injection valves.

12. An injection unit according to claim 10, wherein the injector arrangement comprises a plurality of servo injection valves whose fuel return lines are combined, whereby the combined fuel return line section is provided with the controllable valve.

13. An injection unit according to claim 10, wherein the predefined operating parameters comprise the existence or non-existence of an actuator overshoot in the servo injection valve.

14. An injection unit according to claim 10, wherein the idle state of the valve after an actuation is maintained compulsorily for a stipulated fixed further time interval.

15. An injection unit according to claim 10, further comprising an electronic injection control unit (ECU) for operating the injector arrangement and for actuating the controllable valve.

16. A method for operating an injection unit for an internal combustion engine, comprising an injection unit according to claim 10, the method comprising the steps of:

actuating the control valve by means of a piezoelectric actuator, to cause a displacement of the nozzle body in the direction of an opening of the injection passage, for initiating an injection process by pressure reduction in the control chamber, and blocking of the fuel flow in the fuel return line, said blocking being provided depending on predefined operating parameters of the internal combustion engine and/or of the injection unit and not being lifted again until after expiration of a predeterminable time interval.

17. A method according to claim 16, wherein the predefined operating parameters comprise the existence or non-existence of an actuator overshoot in the servo injection valve.

18. A method according to claim 16, wherein the lifting of the blocking is compulsorily maintained for a stipulated fixed further time interval.

* * * * *